United States Patent [19]

Barbillat

[11] Patent Number: 4,705,185

[45] Date of Patent: Nov. 10, 1987

[54] FLOATING ROOF TANKS FOR LIQUID, IN PARTICULAR TO STORAGE TANKS USED IN THE NUCLEAR POWER INDUSTRY

[75] Inventor: Claude Barbillat, Argenteuil, France

[73] Assignee: Electricite de France, France

[21] Appl. No.: 780,570

[22] Filed: Sep. 26, 1985

[30] Foreign Application Priority Data

Sep. 27, 1984 [FR] France ..... 84 14858

[51] Int. Cl.[4] ..... A45D 1/04

[52] U.S. Cl. ..... 220/222; 220/85 B; 220/216; 220/219; 220/227; 137/356; 376/293

[58] Field of Search ..... 220/85 A, 85 B, 216, 220/219, 221, 222, 227; 376/283, 293, 294; 137/356

[56] References Cited

U.S. PATENT DOCUMENTS

| | | | |
|---|---|---|---|
| 1,561,260 | 11/1925 | Mallery | 137/356 |
| 1,823,256 | 9/1931 | Clark | 220/219 |
| 2,050,686 | 8/1936 | Wiggins | 220/216 |
| 2,061,175 | 11/1936 | Staber | 220/85 A |
| 2,211,958 | 8/1940 | Mahaffey | 137/356 |
| 2,538,412 | 1/1951 | Cecil et al. | 220/227 |

FOREIGN PATENT DOCUMENTS

| | | | |
|---|---|---|---|
| 2453789 | 5/1975 | Fed. Rep. of Germany | 220/222 |

*Primary Examiner*—Deborah L. Kyle
*Assistant Examiner*—Richard W. Wendtland

[57] ABSTRACT

The invention relates to floating roof tanks for liquids, of the type comprising a cylindrical wall (2), a floating roof (3), and a flexible membrane (4) connecting the periphery of the floating roof to the wall. In accordance with the invention, means are provided for emptying the counter-pressure liquid which is located in the space (6) delimited by the membrane (4) and the wall (2) and which is open to the atmosphere. These emptying means are disposed near the top of the tank so that the membrane, under the effect of pressure exerted by the liquid contained in the tank, serves to expel the counter-pressure liquid when the roof is in abutment against a top stop. Such tanks are of particular use in the nuclear power industry for storing de-gased water to top up the primary circuit of a nuclear reactor.

5 Claims, 4 Drawing Figures

FLOATING ROOF TANKS FOR LIQUID, IN PARTICULAR TO STORAGE TANKS USED IN THE NUCLEAR POWER INDUSTRY

This invention relates to floating roof tanks for liquids.

BACKGROUND OF THE INVENTION

Such tanks are used, in particular in the nuclear power industry, as storage tanks for storing liquids such as de-gased distilled water.

Very high reliability is required in this industry in the design of tanks, in order to eliminate any risk of operation being stopped, or worse still any deterioration of their essential component parts. It is also essential for operation to be safe without there being any risk of operating error. Furthermore, since such floating roof tanks are used for topping up the primary circuits of a nuclear reactor, it is necessary for the storage to be protected from the air so as to ensure that the stored liquid is of very high quality, for example, in this particular application de-gased water must have an oxygen content of no more than 100 $\mu g/l$ in order to avoid any risk of oxidation.

Conventionally, such floating roof tanks comprise a cylindrical wall and a floating roof which is surrounded by said wall, and which is connected to it in sealed manner by means of a flexible membrane: a typical example is shown in French Patent Specification No. 2526405. In order to preserve this flexible membrane connecting the periphery of the roof to the side wall of the tank, and in particular in order to avoid kinks forming therein and/or an uncontrolled application thereof against the wall of the tank under the effects of the pressure of the liquid contained in the tank, it is common practice for the space defined by the membrane and the wall of the tank, and in communication with the outside, to receive a counter-pressure liquid which acts essentially as a lubricant for the membrane when the roof moves, and which additionally, at least in some positions, serves to center the said roof relative to the cylindrical wall of the tank.

One of the problems in designing such floating roof tanks lies in controlling the real volume of the counter-pressure liquid, and in particular in emptying this volume.

If this volume is too great, the counter-pressure liquid overflows excessively onto the periphery of the roof, and may drown it when in the low position, which can give rise to a degree of instability and/or to said roof sinking with the consequent risk of damaging the membrane or even the side wall of the tank. If the volume is too small, the membrane runs the risk of sticking to the side wall when the roof is in the high position, and the resulting friction is difficult to control and may damage the membrane.

Further, the volume of the counter-pressure liquid is subjected to the phenomenon of evaporation and this varies depending on location, and on the type of use to which the tank is being put, in other words evaporation varies essentially as a function of temperature and humidity which are diffucult to control accurately. Thus a proposal is made in the above-mentioned French patent specification to cover the surface of the counter-pressure liquid with floating balls or panels in order to reduce evaporation. It should be noted that the side wall of this known tank is provided with an overflow situated at a level below the maximum level reached by the floating roof when in its highest position, but that this overflow cannot under any circumstances be used as emptying means, as can be seen clearly from the high position shown in FIG. 3.

One known technique consists in periodically adding counter-pressure liquid in a highly empirical manner without carefully monitoring the effect of evaporation. In order to have a known real volume of counter-pressure liquid, the tank is completely emptied, the counter-pressure liquid is completely removed, and after these emptying processes, a predetermined volume of counter-pressure liquid is fed into the tank above the roof prior to refilling the tank. This technique has the drawbacks of requiring the tank to be completely emptied, and thus runs the risk of moving the floating roof specifically when its movements may not be properly controlled, and also of a non-negligible loss of operating time which is incompatible with an application in the nuclear power industry.

One proposal which attempts to mitigate these drawbacks consists in emptying the counter-pressure liquid when the roof is in high position via emptying means provided just above the level of the points at which the membrane is fixed to the tank, i.e. half-way up the side wall of the tank. These proposals have not been satisfactory, firstly because the counter-pressure liquid is not completely emptied due to the side wall adhering to a lower zone of the membrane above the emptying means, and secondly since the emptying means are accessible at medium levels, potential users could remove counter-pressure liquid inopportunely, thereby running the risk of its volume being insufficient.

The invention seeks to avoid the above-mentioned drawbacks of the prior art.

One aim of the invention is thus to provide a floating roof tank whose structure ensures that the counter-pressure liquid can be completely removed in an entirely reliable manner when the roof is in its high position.

Another aim of the invention is to provide a tank of simple structure and reasonable manufacturing cost.

Another aim of the invention is to ensure that there is always some liquid stored in the tank, in particular for applications in the nuclear power industry.

A final aim of the invention is to avoid any risk of the counter-pressure liquid being drawn off at inopportune moments.

SUMMARY OF THE INVENTION

A floating roof tank for liquids in accordance with the invention includes the improvement whereby it is fitted with means enabling the counter-pressure volume to be emptied when the roof is in its high position, said means being disposed in the top part of the tank so that the flexible membrane causes the counter-pressure water to be expelled under the effects of the pressure exerted by the liquid contained in the tank.

These means are advantageously constituted by an emptying orifice passing through the wall of the tank near its top, said orifice being connected to a conventional emptying duct outside said wall. Said orifice is preferably disposed close to and below the level which the liquid occupies in the tank when the roof is brought into abutment against top stops defining the highest position of the roof when the said tank is filled, and at a distance below the level of the liquid-line represented by the ratio of said maximum volume divided by the area of the ring formed by the plane of the counter-pressure liquid.

In addition, it is advantageous to provide means for preventing the emtying orifice from being closed by the flexible membrane, for example a flat member fixed to the inside wall and having a projecting portion so as to avoid any direct contact between the emptying orifice and the flexible membrane in the vicinity of said flat member.

BRIEF DESCRIPTION OF THE DRAWINGS

An embodiment of the invention is described by way of example with reference to the accompanying drawings, in which.

MORE DETAILED DESCRIPTION

Figure 1:
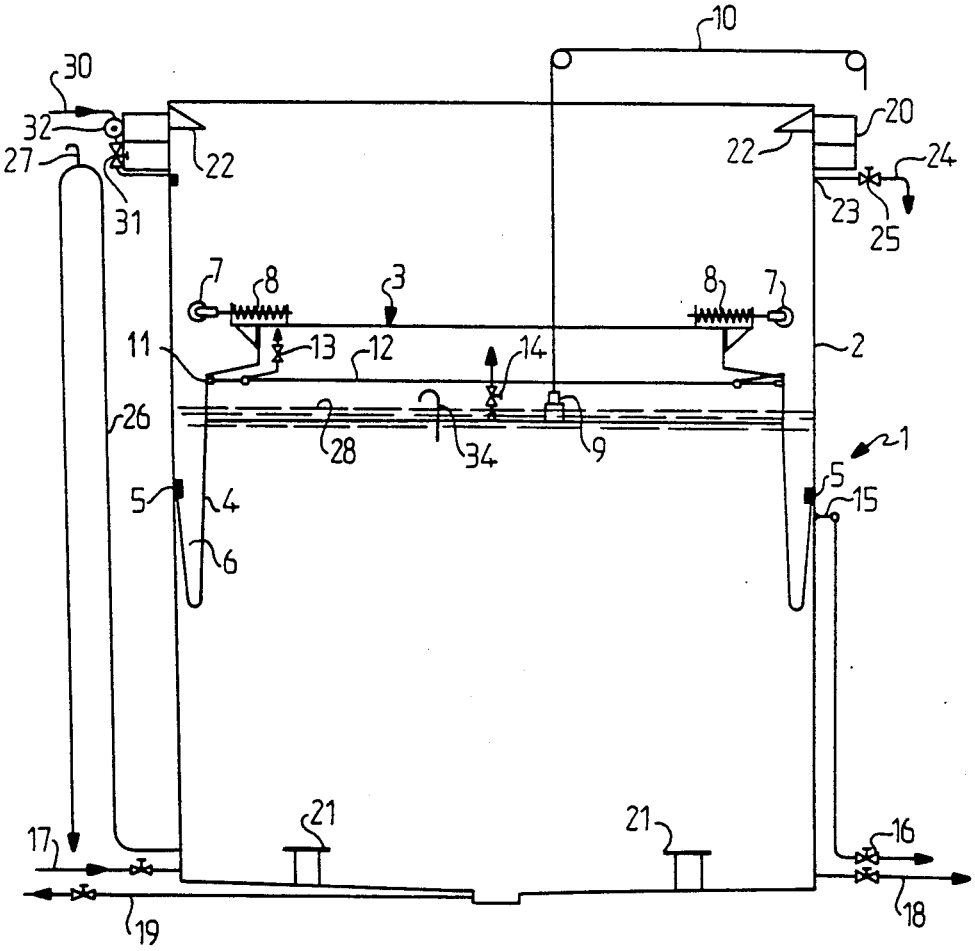
FIG. 1 is a vertical section through a floating roof tank in accordance with the invention.

In FIG. 1, a floating roof tank 1 for liquids has a generally cylincrical wall 2, a floating roof 3 in the form of an open-top caisson, and a flexible membrane 4 connecting the periphery of the floating roof in a watertight manner to the side wall of the tank. It should be noted that the membrane 4 is connected, in this case, halfway up the tank at 5, but that the invention is also applicable to a membrane connected further up the tank. In accordance with the conventional technique, the space 6 which is open to the outside as defined by the membrane 4 and the wall 2 of the tank is suitable for receiving a counter-pressure liquid whose main purpose is to lubricate the flexible membrane 4, and in particular to prevent kinks being formed therein due to movements of the floating roof 3, and which also serves, at least in some positions, to center the said roof relative to the tank wall.

FIG. 1 shows diagrammatically much of the equipment which is conventionally provided in conjunction with floating roof tanks for liquids. This equipment is described briefly, given that the person skilled in the art is familiar with such equipment.

The floating roof 3 is thus provided with six guide wheels 7 which are evenly distributed around the top of the roof and which are urged radially outwardly by springs 8 to press the wheels against the wall 2 of the tank in all possible positions of the roof. Advantageously, the size of the floating roof with its guide wheels always remains less than the diameter of the tank, to make it possible (although undesirable) for the roof to turn over completely without jamming against the wall of the tank. The floating roof 3 is also provided with an analog tilt-measuring device 9 connected via a cable 10 which has a degree of slack and a counterweight to send alarm signals to a control room, thus enabling the slope of the roof to be monitored if it should catch in an intermediate position while operating in the lower portion of the tank or while emptying the tank. The floating roof 3 is also equipped, close to the membrane-roof junction with peripheral vents 11 connected via a venting manifold 12 which is fitted with a valve 13. The roof may also be fitted with an air bleeder 14 in the middle thereof supposing that its shape is such as to moke it impossible to ensure that all of the air trapped under the roof can be evacuated via the peripheral vent 11. Finally, the floating roof is fitted with a vacuum-releasing tube 34 which formes a natural valve to protect the tank against the pressure of the liquid being excessively reduced while the tank is being emptied and when the roof is in its bottom position, or supposing the roof jams in a intermediate position (furthermore, if the roof does jam, the tube can also serve as an outlet should the pressure rise excessively).

The tank per se is fitted with manual venting means below the level of the join 5 between the membrane and the tank wall, said venting means including a plurality of vents uniformly distributed around the periphery of the tank and connected via a manifold 15 and a valve 16 to an outlet pipe. Inlet ducts 17 are provided at the bottom of the tank, as are outlet ducts 18, and emptying ducts 19, all of which ducts serve to convey the liquid stored in the tank. A circular gangway 20 is provided around the top of the tank to facilitate inspecting the roof and the membrane.

Movement of the floating roof is limited by bottom stops 21 and by top stops 22, and an indicator and alarm equipment (not shown) is provided to monitor the extreme full and empty positions in a control room.

As explained in the introduction to the present specification, it is important to monitor the real volume of counter-pressure liquid contained in the space 6, and it is also important to monitor the emptying of this volume.

Figure 2:
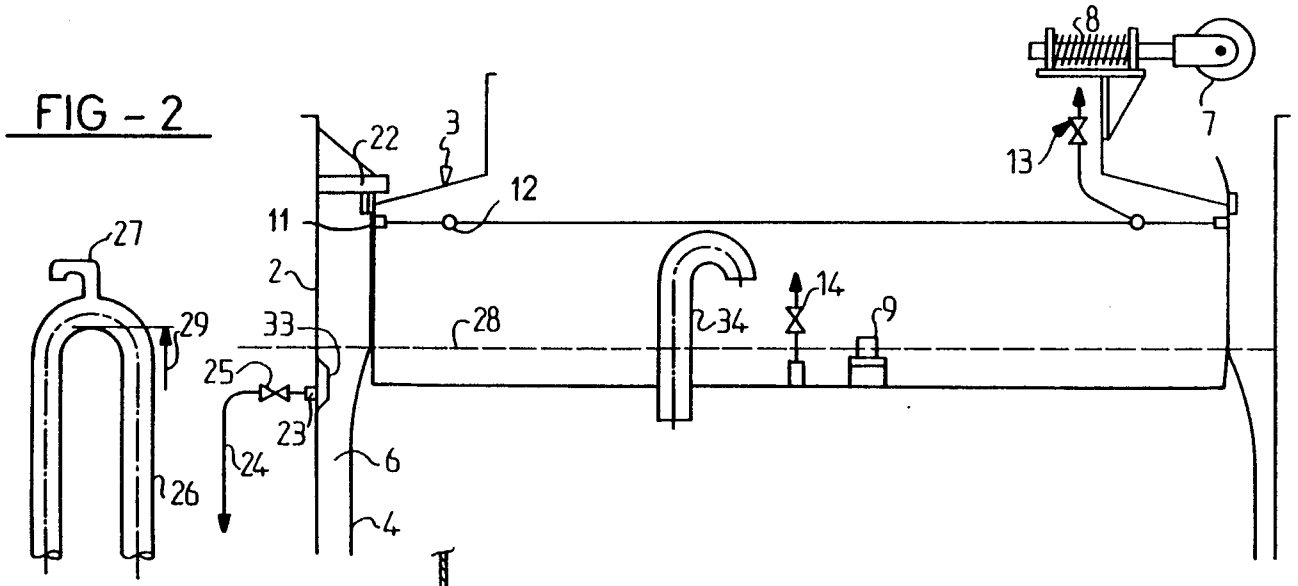
FIG. 2 is a section through a portion of a tank whose roof is in its high position.

In accordance with the invention, the tank is fitted with means enabling the volume of counter-pressure liquid to be emptied when the roof is in its high position. As shown in FIGS. 1 and 2, these means comprise an emptying orifice 23 passing through the wall 2 near the top of the tank and connected to a conventional emptying pipe 24 fitted with a valve 25 and located outside the tank wall.

In order to empty the counter-pressure liquid, the tank is filled, thereby lifting the floating roof until it abuts against its top stops 22 (FIG. 2). In order to protect the tank against over-filling, it may be provided with an upside-down U-shaped overflow pipe 26 having a siphon-breaking duct 27 at the top thereof. In such a case, the tank is filled until the level of the liquid-line 28 (which is substantially the same as the level of the surface of the counter-pressure liquid) reaches the level 29 of the overflow, which is slightly above the level occupied at the beginning of top abutment, thereby providing additional safety and ensuring that the floating roof is indeed at its topmost position.

The tank is then isolated by closing the valve in the inlet duct 17, and then the valve 25 connected to the emptying orifice 23 is opened. This orifice is provided at a lower level than the level 28 of the liquid-line when the roof is in top abutment, and allows the entire volume of the counter-pressure liquid to be emptied under the natural effect of the pressure of the liquid inside the tank tending to urge the flexible membrane 4 radially outwardly, and thus to expel the counter-pressure liquid until the entire portion of the membrane which is lower than the emptying orifice is pressed against the inside wall of the tank.

By virtue of this disposition of the invention, it is possible to completely empty the counter-pressure liquid when the roof is in its high position. Counter-pressure liquid filling means are then actuated to admit a predetermined volume of counter-pressure liquid. These means are preferably disposed at the top of the tank at substantially the same level as the emptying means, and may be constituted, for example (see FIG. 1) by a duct 30, a valve 31, and a volume meter 32.

It is important to observe that the emptying orifice is located in a high position which is chosen as a function of the maximum volume of counter-pressure liquid and is preferably at a distance from the liquid line defined by the ratio $V_{max}/S$, where $V_{max}$ is said maximum volume, and S is the surface area of the ring constituted by the plane of the counter-pressure liquid. The importance of this emptying level stems in particular from the fact that when the emptying valve 25 is opened the roof moves slightly downwwards as the counter-pressure liquid is expelled. It is important to be certain that the level 28 of the liquid line remains above the level of the emptying orifice 23 in order to ensure that the counter-pressure liquid is completely emptied. In addition, the high position of the emptying orifice makes it impossible for counter-pressure liquid to be drawn off at an untimely moment when the roof is situated at a normal operating level, i.e. below its high point.

Figure 4:
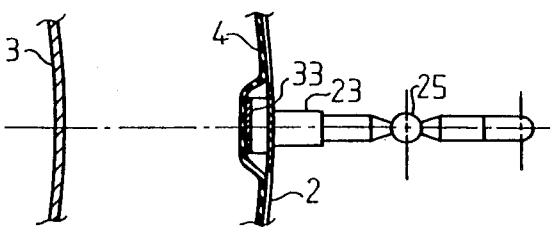
FIG. 4 is a section on IV—IV of FIG. 3.
Figure 3:
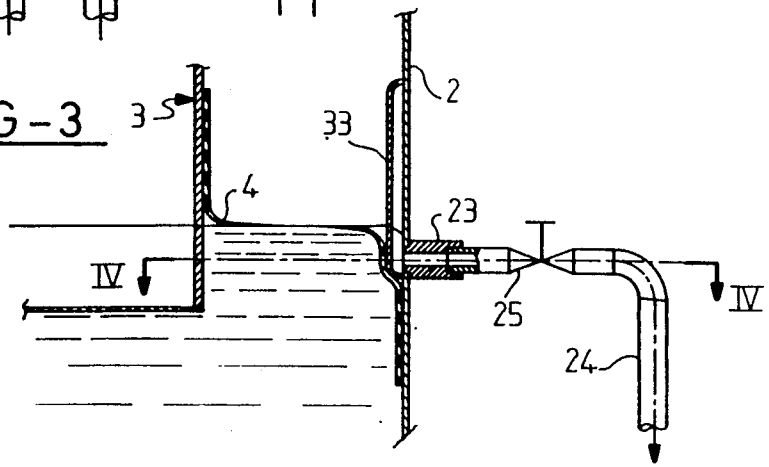
FIG. 3 is a section through a portion of the tank showing details of the members for emptying the counter-pressure liquid.

FIGS. 3 and 4 show means for ensuring that the emptying orifice is not closed by the flexible membrane while the counter-pressure liquid is being emptied. These means are constituted by a flat member 33 fixed to the side wall 2 and having a projecting portion which prevents the emptying orifice 23 from being closed while still allowing the liquid to pass around the flat member.

It should be observed that the volume of the counter-pressure liquid is predetermined when the empty tank is filled for the first time in exactly the same way as after the counter-pressure liquid has been emptied, i.e. with the roof in its high position.

For applications in the nuclear power industry, the counter-pressure liquid is advantageously distilled water. The design of a floating roof tank in accordance with the invention thus makes it possible to avoid bringing the liquid in the tank into contact with the air, thereby avoiding the need to de-gas this liquid more than once (communication with atmospheric air via the siphon-breaking outlet of the overflow and via the vacuum-braking tube cause only negligible disturbance since the siphon-breaking opening is far removed from its point of communication with the tank (at the bottom), and the vacuum-breaking tube includes a lower liquid plug which provides an effective screen).

Naturally the invention is not limited to the particular embodiment described by way of example, but extends to any variant, including the use of equivalent means, as defined by the following claims.

I claim:

1. A floating roof tank for liquids, the tank comprising a cylindrical wall, a floating roof surrounded by said cylindrical wall, a flexible membrane connecting said floating roof to said wall in a watertight manner, said membrane defining together with the wall of the tank a space which is suitable for receiving a counter-pressure liquid, and the tank including the improvement whereby it is fitted with means for emptying the volume of counter-pressure liquid when the roof is in its high position, said emptying means being disposed in the upper portion of the tank in such a manner that the flexible membrane serves to expel the counter-pressure liquid under the effect of the pressure exerted on the membrane by the liquid contained in the tank, said emptying means including an emptying orifice passing through the wall of the tank in the upper portion thereof, said orifice being connected to a conventional emptying duct outside said wall, and said emptying means further including means for preventing said emptying orifice from being closed by the flexible membrane, such that a complete emptying of the counter-pressure liquid can be achieved.

2. A floating roof tank according to claim 1, wherein the emptying orifice is disposed close to and below the level occupied by the liquid in the tank when the roof is brought, by said tank being filled, into abutment against top stops defining the highest position of said roof.

3. A floating roof tank according to claim 1, wherein the level of the emptying orifice is chosen as a function of the maximum volume of counter-pressure liquid, and is preferably at a below the level of the liquid-line by a distance obtained by dividing said maximum volume by the area of the ring formed by the plane of the counter-pressure liquid.

4. A floating roof tank according to claim 1, wherein the means for preventing the orifice being closed are essentially constituted by a flat member fixed on the inside wall of the tank, and having a portion projecting into the tank in such a manner as to prevent any direct contact between the emptying orifice and the flexible membrane in the vicinity of said flat member.

5. A floating roof tank according to claim 1, further including counter-pressure liquid filling means, said means being disposed at the top of the tank at a level close to that of the emptying means.

* * * * *